US005637817A

United States Patent [19]

Sherman

[11] Patent Number: 5,637,817

[45] Date of Patent: Jun. 10, 1997

[54] GUITAR AND TREMOLO ARM

[76] Inventor: Gery Sherman, 12808 Teaberry Rd., Silver Spring, Md. 20906

[21] Appl. No.: 355,260

[22] Filed: Dec. 8, 1994

Related U.S. Application Data

[63] Continuation-in-part of Ser. No. 913,679, Jul. 15, 1992, abandoned, which is a continuation-in-part of Ser. No. 819,584, Jan. 9, 1992, Pat. No. 5,373,769, which is a continuation-in-part of Ser. No. 710,211, Jun. 4, 1991, abandoned.

[51] Int. Cl.[6] ..... G10D 3/00

[52] U.S. Cl. ..... 84/313

[58] Field of Search ..... 84/313, 267, 297 R, 84/298, 307

[56] References Cited

U.S. PATENT DOCUMENTS

| | | | |
|---|---|---|---|
| 4,285,262 | 8/1981 | Scholz | 84/313 |
| 4,656,915 | 4/1987 | Osuga | 84/313 |
| 4,671,157 | 6/1987 | Fender | 84/313 |
| 4,681,010 | 7/1987 | Wilkinson | 84/298 |
| 4,852,448 | 8/1989 | Hennessey | 84/313 |
| 5,113,737 | 5/1992 | Gregory | 84/267 |

*Primary Examiner*—Cassandra C. Spyrou

[57] ABSTRACT

A guitar includes a tremolo device disposed on its body. The tremolo device engages and varies the tension of one or more guitar strings. There is a tremolo arm which is precisely attached to the tremolo device for movement thereof without unwanted play. In a preferred embodiment of the invention the rotation resistance (i.e., pre-load) between the tremolo arm and the base plate is variable and can be set and maintained even under severe use conditions.

17 Claims, 2 Drawing Sheets

GUITAR AND TREMOLO ARM

CROSS REFERENCE TO RELATED APPLICATIONS

This application is a continuation-in-part of application Ser. No. 07/913,679, filed Jul. 15, 1992 now abandoned, which is a continuation-in-part of application Ser. No. 07/819,584, filed Jan. 9, 1992 now U.S. Pat. No. 5,373,769, which is a continuation-in-part of application Ser. No. 07/710,211, filed Jun. 4, 1991, now abandoned. Application Ser. No. 07/913,679 and application Ser. No. 07/819,584, which issued as U.S. Pat. No. 5,373,769, are incorporated herein by reference.

FIELD OF THE INVENTION

This invention relates to musical instruments known as guitars, particularly to guitars equipped with tremolo devices for dynamically altering the pitch of the guitar, and more particularly to the tremolo arms therefor.

BACKGROUND OF THE INVENTION

Tremolo devices are well known to those skilled in the musical instruments art for varying the pitch of the strings on a guitar.

The tremolo is mounted on the body of the guitar and becomes an integral part of the guitar.

Each of the guitar strings is held taut at one end by the tremolo, and the other end of each of the guitar strings connects to a respective tuner, with the tuners mounted on a headstock. The guitar strings are taut and traverse over the length of the neck of the guitar to the headstock. At the end of the neck, which is connected to the headstock, the strings pass over or through a nut.

While playing a guitar equipped with a tremolo, a guitarist can vary the pitch of the strings by tilting the tremolo arm which increases or decreases string tension.

A problem associated with prior art tremolo devices is the design of the tremolo arm assembly, which is required to have a specific tension so that the tremolo arm can remain in a fixed position. Constant swiveling of the tremolo arm, in and out of playing position, relaxes the tension on the tremolo arm and causes the tremolo arm to be unable to stay in a fixed position. Also, prior tremolo arm assemblies are not manufactured with precision and the tremolo arm tension is difficult to adjust due to deficient design.

For example, as shown in FIG. 4, Floyd Rose marketed a prior art adjustable tremolo arm having an arm, a hollow threaded-tremolo-arm-assembly shaft with two opposed flat sided shoulders, a locking nut, two plastic washers, a metal washer and a keyway washer. A sample of this Rose arm which was tested was difficult to use and to maintain a desired pre-load on the arm. The tested Rose sample was likewise prone to deformation of the supplied plastic washers, thereby leading to undesirable loosening of the components (and loss of the desired pre-load). There is a need for an adjustable tremolo arm which precisely retains the desired tension established by the user.

OBJECTS AND SUMMARY OF THE INVENTION

Accordingly, it is an object of the invention to overcome the drawbacks of prior art devices.

Another object of the invention is to provide a guitar having an improved tremolo arm which is more precise than conventional devices.

A further object of the invention is to provide a guitar having a tremolo arm which can be more accurately adjusted than known devices.

A yet further object of the invention is to provide a tremolo arm which can have its tension (resistance to turning) precisely set by the user.

A still further object of the invention is to provide a guitar having a tremolo arm assembly which can be accurately adjusted to fit the individual requirements of a guitarist.

A still further object of the invention is to provide a guitar having an adjustable tremolo arm assembly which retains its adjusted state for an indefinite period of time, even under severe use conditions.

It is another object of the invention to provide a tremolo arm assembly which provides the numerous advantages described above.

A general object of the invention is to provide an improved tremolo device for varying the pitch of the strings on a guitar.

Another object of the invention is to improve the function of the tremolo arm assembly.

According to the present invention, as embodied and broadly described herein, a guitar is provided which has a body, a headstock, a neck, a tremolo and a plurality of strings. The neck connects at a first end to the body and at a second end to the headstock. The plurality of strings stretch from the headstock to the bridge portion of the tremolo.

The present invention includes a new tremolo arm assembly which holds its adjusted tension, preventing the tremolo arm from rotating freely; which is easy to adjust when the tremolo is mounted on the guitar body; and which is designed and manufactured to be connected to the base plate in a precise manner, eliminating both unwanted play in the tilting movement of the tremolo arm and unwanted stiffness and unevenness in the rotation of the tremolo arm.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE INVENTION

Figure 1:
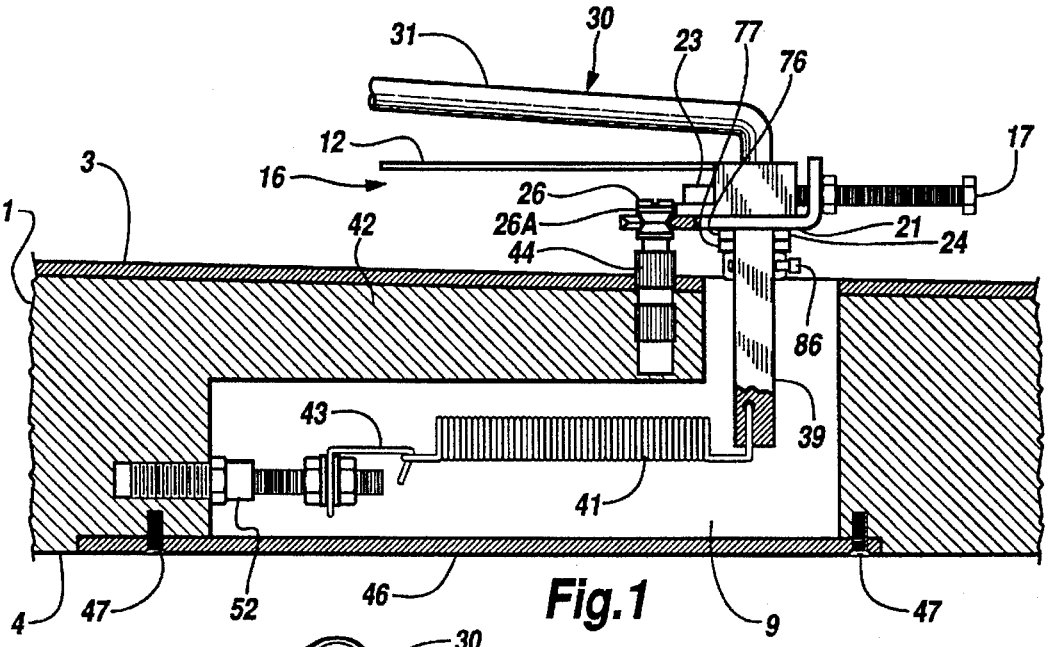
FIG. 1 shows a partial sectional view of a guitar body and illustrates a support system of a tremolo and a tremolo arm assembly.

Reference will now be made in detail to the present preferred embodiments of the invention, examples of which are illustrated in the accompanying drawing, wherein like reference numerals indicate like elements throughout the views.

Figure 2:
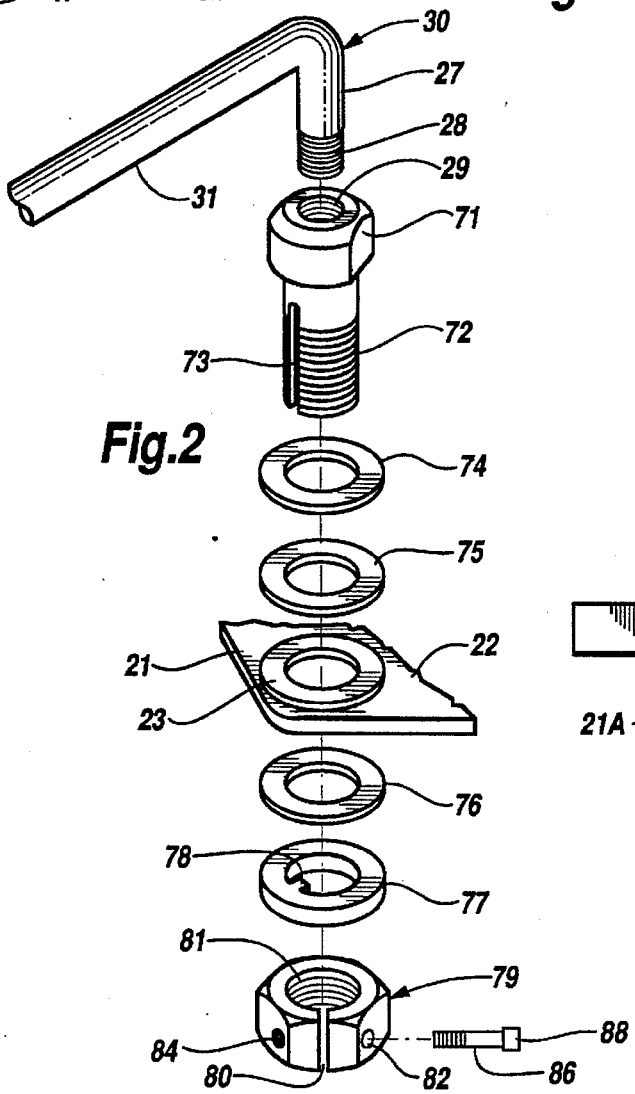
FIG. 2 shows an exploded view of a tremolo arm assembly attached to a tremolo base plate.
Figure 3:
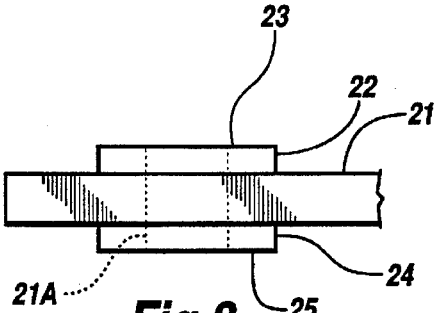
FIG. 3 illustrates a partial side view of a tremolo base plate according to a preferred embodiment of the invention.

In the preferred embodiment shown in FIGS. 1–3 the basic components of the guitar are illustrated as a body 1 have a face 3 and a back side 4.

As is well known, and shown in my earlier applications, there will typically be a number of tuners on a headstock at the head end of the guitar.

FIG. 2 shows a portion typically at the base end of the guitar and in which a tremolo cavity 9 will typically be formed and at which one of a plurality of strings 12 is connected to a tremolo device 16.

Tremolo device 16 includes a tremolo arm assembly 30 for manipulation thereof.

The tremolo cavity 9 may have the largest portion of its volume opening to the back side 4 of the guitar body 1. Tremolo cavity 9 houses one or more springs 41, a spring claw 43, a spring claw fastener 52, and a spring arm 39 of the tremolo device 16. The tremolo cavity 9 typically has at least one covering plate 46 made of plastic or other appropriate material. The covering plate 46 covers the tremolo cavity 9 and is secured to the back of the guitar body 1 by screws 47. The covering plate 46 provides access to the tremolo device 16 and tremolo arm assembly 30, respectively.

Tremolo device 16 preferably includes a tremolo base plate 21 pivotably attached to guitar body 1. The pivotable attachment is preferably provided by means of a threaded stud 26 providing a pivot point, such as a V-shaped notch 26A about which base plate 21 pivots. Goods results have been achieved when a stud casing 44 is provided between stud 26 and guitar body 1. Stud casing 44 is preferably configured for being secured to guitar body 1, such as by the provision of exterior grooves, as well as detachably receiving threaded stud 26.

Tremolo base plate 21 preferably includes an upper boss 22 having an outer bearing surface 23, as well as a lower boss 24 having a respective outer bearing surface 25. A through hole 21A in base plate 21 is sized for receiving a tremolo arm 31.

Good results have been achieved thanks to the provision of upper and lower bearing surfaces 23, 25, as the provision of such on respective outwardly extending bosses 22, 24 ensures that bearing surfaces 23, 25 can be accurately machined for precise operation of my invention. Preferably, upper bearing face 23 is contained in a plane parallel to lower bearing surface 25. The optimal results owing to the provision of bearing faces 23, 25 include smooth bearing surfaces for consistent, smooth rotation of arm 31, as well as the elimination of play in the arm 31 relative to base plate 21 (and, hence relative to guitar body 1) when tremolo arm 31 is tilted for varying the tension of strings 12.

A separate covering plate, not shown in the figures, can be used for simplicity to cover only the portion of the tremolo cavity 9 containing the split-hexagonal nut 79 of the tremolo arm assembly, which is discussed in detail below.

An exploded view of the new tremolo arm assembly 30 is illustrated in FIG. 2.

The tremolo arm assembly 30 includes tremolo arm 31, which is an elongated, cylindrical shaft that bends at a first end 27, with the first end 27 having threads 28 which connect the tremolo arm 31 into internal threads 29 extending through a two flat sided shoulder 71 of a threaded-tremolo-arm-assembly shaft 72, i.e. the shoulder 71 has two sides which are flat surfaces. The two flat sided shoulder 71 is used during installation and adjustment of the tremolo arm assembly 30 which is connected to the tremolo base plate 21. External threads 28 engage with internal threads 29 and establish a pre-load when sufficient torque is applied to tremolo arm 31. When arm 31 is inserted into threaded-tremolo-arm-assembly shaft 72, the user holds the two flat sided shoulders 71 with a wrench, for example, and tremolo arm 31 is rotated in a direction for engaging and tightening threads 28 and 29 relative to each other; a sufficient pre-load is established so that arm 31 will not loosen relative to assembly shaft 72 during use.

The threaded-tremolo-arm-assembly shaft 72 extends below the two flat sided shoulder 71, with the threaded-tremolo-arm-assembly shaft 72 having a key-way groove 73 running along the length of the threaded-tremolo-arm-assembly shaft 72. The key-way groove 73 is cut out of the threads of the threaded-tremolo-arm-assembly shaft 72 and preferably has a depth greater than the depth of the threads of the threaded-tremolo-arm-assembly shaft 72. Also, the height of the key-way groove 73 is preferably greater than the vertical distance between the threads (as viewed in FIG. 2) of the threaded-tremolo-arm-assembly shaft 72.

A washer 74 is placed along the threaded-tremolo-arm-assembly shaft 72 below the two flat sided shoulder 71. Below the washer 74, a first washer 75 is disposed. Preferably, first washer 75 is made of highly wear-resistant and deformation-resistant material having low friction, and is placed along the threaded-tremolo-arm-assembly shaft 72. The threaded-tremolo-arm-assembly shaft 72 is then placed through the base plate 21. Below the base plate 21 and along the threaded-tremolo-arm-assembly shaft 72, a second washer 76 is placed. Second washer 76 is likewise preferably made of highly wear-resistant and deformation-resistant material having low friction. By experimentation, the use of highly wear-resistant and deformation-resistant, low friction washers 75, 76 made from a plastic called DELRIN 500CL™ produced the best results for providing low friction to the new tremolo arm assembly 26, as shown in FIG. 2, where DELRIN 500CL™ is a chemically lubricated version of polyoxymethylene, a crystalline thermoplastic homopolymer made by DuPont by the polymerization of formaldehyde.

Below the second washer 76, a key-way washer 77 is placed along the threaded-tremolo-arm-assembly shaft 72 with a key portion 78 slidably engaging the key-way groove 73. The key portion 78 of the key-way washer 77 is preferably thicker than the vertical distance between adjacent threads of the threaded-tremolo-arm-assembly shaft 72.

Good results have been achieved when key portion 78 extends into the key-way groove 73 at a depth that is greater than the depth of the threads of the threaded-tremolo-arm-assembly shaft 72.

The dimensions of the key portion 78 and the key-way groove 73 prevent the key portion of the key-way washer from sliding between the threads of the threaded-tremolo-arm-assembly shaft 72. Thus, the key-way washer 77 helps prevent the tremolo arm assembly from becoming loose during use of the tremolo.

A split-hexagonal nut 79 made from stiff material is provided, as shown in FIG. 2, having a slot 80, and internal threads 81, as well as a first screw hole 82 with threads aligned with a second screw hole 84 with threads. The combination of the first and the second screw holes 82, 84 allows a screw 86 to pass through the first and second screw holes 82, 84 across the slot 80 of the split-hexagonal nut 79 by threading the screw 86 through each of the threads of the first and second screw holes. With the screw 86 threading and passing through one side of the split-hexagonal nut 79, through the first screw hole 82, across the slot of the split-hexagonal nut 79, and through the second screw hole 84, the split-hexagonal nut 79 is screwed along (i.e., moved along) the threads of threaded-tremolo-arm-assembly shaft 72. Thus, in between the two flat sided shoulder 71 and split-hexagonal nut 79, the washer 74, the first washer 75, the base plate 21, the second washer 76, the key-way washer 77, are clamped. Good results have been achieved when first screw hole 82 has an enlarged outer opening for receiving a head 88 of screw 86.

When the tremolo arm assembly shown in FIG. 2 is tightened, the screw 86 is tightened as desired to clamp split-hexagonal nut 79 together to thus clamp the internal threads 81 of the split-hexagonal nut 79 tight against the threaded-tremolo-arm-assembly shaft 72, as well as to clamp the internal threads 29 of threaded-tremolo-arm-shaft 72 against external threads 28 of tremolo arm assembly 31. By tightening the screw 86, the friction between the split-hexagonal nut 79 and the threaded-tremolo-arm-assembly shaft 72 is increased, causing the tremolo arm assembly 30 to stay tight to prevent the tremolo arm 31 from rotating freely relative to tremolo base plate 21, and, hence, relative to guitar body 1. The tension between the components can be varied precisely so as to yield a completely locked arm 31, arm 31 having a desired degree of resistance to rotation as established by the user, or even essentially unrestricted movement of arm 31 when sufficiently loose (i.e., the desired pre-load on arm 31 is precisely established and indefinitely maintained). My inventive structure allows for a desired, predetermined resistance to movement to be established between the arm 31 and base plate 21, for example, while precisely maintaining that predetermined resistance (i.e., pre-load) despite long periods of use.

Once installed, the tremolo arm assembly 30 can be adjusted easily through a hole in the back of the guitar by removing the covering plate 46, by loosening the screw 86 with a screwdriver or an allen wrench which mates with screw head 88, and then by placing a socket over the split-hexagonal nut 79 while placing a wrench over the two flat sided shoulder 71. The use of split-nut 79 and screw 86 precludes the possibility of inadvertent loosening of arm 31 thereby changing its predetermined degree of resistance to rotation.

The tremolo arm assembly 30 has been successfully built and stays tight, preventing the tremolo arm 31 from interrupting play. My invention also eliminates unwanted play in the tilting movement of the tremolo arm 31 and unwanted stiffness and unevenness in the rotation of the tremolo arm 31 owing to the provision of bearing faces 23, 25 which may be precisely machined. Such precision machining allows the consistent clamping of the components for accurate smooth operation thereof. Still further, the provision of one or more wear-resistant and deformation-resistant washers 75, 76 contributes to the indefinite maintenance of the desired pre-load.

To remove arm 31 after play, hold shoulder 71 with a wrench, and unscrew arm 31.

Figure 4:
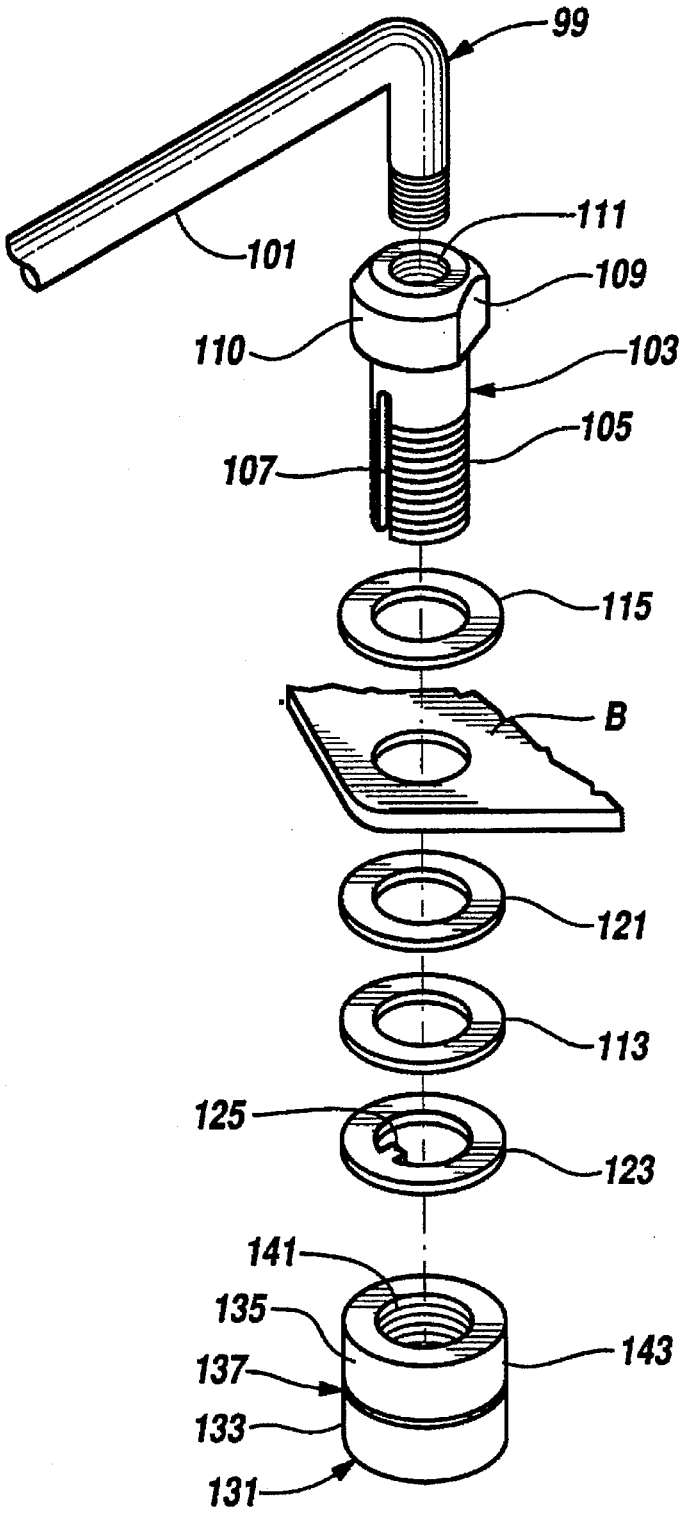
Fig.4 (PRIOR ART)
FIG. 4 shows an exploded view of a PRIOR ART tremolo arm assembly attached to a conventional base plate.

FIG. 4. illustrates one of the PRIOR ART devices over which my invention improved. The illustrated tremolo arm assembly 99 was marketed by Floyd Rose. Tremolo arm assembly 99 includes a tremolo arm 101 and a threaded-tremolo-arm-assembly shaft 103. Threaded-tremolo-arm-assembly shaft 103 includes external threads 105 and a keyway groove 107. There are likewise provided two spaced opposed flat faces 109 configured for receiving a wrench when a user tightens tremolo arm 101 by rotating tremolo arm 101 relative to threaded-tremolo-arm-assembly shaft 103 after inserting arm 101 into opening 111 and engaging the threads thereof with unillustrated internal threads formed inside threaded-tremolo-arm-assembly shaft 103.

In use, threaded-tremolo-arm-assembly shaft 103 would be inserted through a plastic washer 115, base plate B, a further plastic washer 121, a metal washer 113, and a metal keyway washer 123. Keyway washer 123 was relatively thin and included a keyway 125 configured for engaging with keyway 107 of threaded-tremolo-arm-assembly shaft 103. In the PRIOR ART tremolo arm assembly 99 known to the present inventor, metal keyway washer 123 was relatively thin and, as such, keyway 125 was able to rotate out of "engagement" with keyway groove 107 and slide between adjacent ones of external threads 105. Thus, the prior art tremolo arm assembly 99 was prone to loosening, and it was difficult for a user to maintain the desired adjustments.

A locking nut 131 was provided for clamping washer 113, plastic washer 115, base plate B, plastic washer 121, and metal washer 123 between shoulders 110 of threaded-tremolo-arm-assembly shaft 103 and locking nut 131.

Locking nut 131 was apparently intended to maintain its present tension when threaded onto external threads 105 of threaded-tremolo-arm-assembly shaft 103 owing to its having a lower portion 133 separated from an upper portion 135 by a groove 137 extending around the majority of the perimeter of locking nut 131. Internal threads 141 were configured for mating with external threads 105 of threaded-tremolo-arm-assembly 103.

Opposed flat faces 143 were provided on locking nut 131 for engagement by a wrench so that locking nut 131 could be tightened relative to threaded-tremolo-arm-assembly shaft 103 with the other components disposed therebetween as discussed above.

Tremolo arm assembly 99 had no provisions for fixedly locking locking nut 131 relative to threaded-tremolo-arm-assembly shaft 103.

Accordingly, there was a need for my invention, as described above, which overcame the drawbacks of this prior art device.

It will be apparent to those skilled in the art that various modifications can be made to the improved tremolo device of the instant invention without departing from the scope or spirit of the invention, and it is intended that the present invention cover modifications and variations of the improved tremolo device provided they come within the scope of the appended claims and their equivalents.

I claim:

1. A tremolo device for use with a guitar, comprising:

a base plate, said base plate having a hole;

a tremolo arm;

a threaded-tremolo-arm-assembly shaft projecting from said tremolo arm, said threaded-tremolo-arm-assembly shaft including external threads and being configured for being positioned through said base plate hole;

a split nut disposed on said threaded-tremolo-arm-assembly shaft for securing said tremolo arm to said base plate, said split nut having internal threads, a slot, a first screw hole, and a second screw hole, said second screw hole having internal threads; and a screw configured for passing through said first screw hole, across said slot, and into said second screw hole;

whereby said screw engages said split nut to increase the friction between the internal threads of said split nut against said tremolo-arm-assembly-shaft.

2. A tremolo device as recited in claim 1, wherein said first screw hole has threads for engaging said screw.

3. A tremolo device as recited in claim 1, wherein said tremolo arm comprises external threads, and said threaded-tremolo-arm-assembly shaft comprises a hollow portion and internal threads for engagement of said tremolo arm with said threaded-tremolo-arm-assembly shaft.

4. A tremolo device as recited in claim 1, further comprising:

a washer having a key axially positioned between said base plate and said split nut; and said threaded-tremolo-arm-assembly shaft having a key-way groove running along a length of said threaded-tremolo-arm-assembly shaft;

wherein said key of said washer is configured for mating with said key-way groove.

5. A tremolo device as recited in claim 1, wherein said base plate comprises:

an upper boss concentric to said hole, and a lower boss concentric to said hole, said upper boss and said lower boss each having an outer bearing surface.

6. A tremolo device as recited in claim 1, wherein said threaded-tremolo-arm-assembly shaft further comprises a shoulder, said tremolo device further comprising:

a first washer positioned axially along said threaded-tremolo-arm-assembly shaft between said shoulder and said base plate;

a second washer positioned axially along said threaded-tremolo-arm-assembly shaft between said base plate and said split nut.

7. A tremolo device as recited in claim 1, wherein said split nut is hexagonal in shape.

8. A tremolo device as recited in claim 4, wherein said key is sized to avoid sliding between said threads of said threaded-tremolo-arm-assembly shaft.

9. A tremolo device for use with a guitar, comprising:

a base plate, said base plate having a hole;

a tremolo arm having external threads at one end;

a threaded-tremolo-arm-assembly shaft comprising a hollow portion and internal threads for engagement of said tremolo arm with said threaded-tremolo-arm-assembly shaft, said threaded-tremolo-arm-assembly shaft including external threads and being configured for being positioned through said base plate hole;

a split nut disposed on said threaded-tremolo-arm-assembly shaft for securing said tremolo arm to said base plate, said split nut having internal threads, a slot, a first screw hole, and a second screw hole, said second screw hole having internal threads; and a screw configured for passing through said first screw hole, across said slot, and into said second screw hole;

whereby said screw engages said split nut to increase the friction between the internal threads of said split nut against said tremolo-arm-assembly-shaft.

10. A tremolo device as recited in claim 9, wherein said first screw hole has threads for engaging said screw.

11. A tremolo device as recited in claim 9, further comprising:

a washer having a key axially positioned between said base plate and said split nut; and said threaded-tremolo-arm-assembly shaft having a key-way groove running along a length of said threaded-tremolo-arm-assembly shaft;

wherein said key of said washer is configured for mating with said key-way groove.

12. A tremolo device as recited in claim 9, wherein said base plate comprises:

an upper boss concentric to said hole, and a lower boss concentric to said hole, said upper boss and said lower boss each having an outer bearing surface.

13. A tremolo device as recited in claim 9, wherein said threaded-tremolo-arm-assembly shaft further comprises a shoulder, said tremolo device further comprising:

a first washer positioned axially along said threaded-tremolo-arm-assembly shaft between said shoulder and said base plate;

a second washer positioned axially along said threaded-tremolo-arm-assembly shaft between said base plate and said split nut.

14. A tremolo device as recited in claim 9, wherein said split nut is hexagonal in shape.

15. A tremolo device as recited in claim 9, wherein said key is sized to avoid sliding between said threads of said threaded-tremolo-arm-assembly shaft.

16. A tremolo device as recited in claim 12, wherein said threaded-tremolo-arm-assembly shaft further comprises a shoulder, said tremolo device further comprising:

a first washer positioned axially along said threaded-tremolo-arm-assembly shaft between said shoulder and said upper boss of said base plate;

a second washer positioned axially along said threaded-tremolo-arm-assembly shaft between said lower boss of said base plate and said split nut.

17. A tremolo device as recited in claim 12, wherein said first washer and said second washer are made of wear-resistant and deformation resistant material having low friction.

* * * * *